US006569347B1

(12) United States Patent
Yajima et al.

(10) Patent No.: US 6,569,347 B1
(45) Date of Patent: May 27, 2003

(54) REFRIGERATING MACHINE OIL AND REFRIGERATOR USING THE SAME

(75) Inventors: Ryuzaburo Yajima, Osaka (JP); Koichi Kita, Osaka (JP); Shigeharu Taira, Shiga (JP); Youichi Oonuma, Shiga (JP); Masaki Nomura, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 09/091,892

(22) PCT Filed: Dec. 25, 1996

(86) PCT No.: PCT/JP96/03792

§ 371 (c)(1),
(2), (4) Date: Jun. 26, 1998

(87) PCT Pub. No.: WO97/24415

PCT Pub. Date: Oct. 7, 1997

(30) Foreign Application Priority Data

Dec. 28, 1995 (JP) ..... 7-342651
Feb. 29, 1996 (JP) ..... 8-43221

(51) Int. Cl.[7] ..... C09K 5/00
(52) U.S. Cl. ..... 252/68; 62/114; 62/468
(58) Field of Search ..... 508/577; 252/68; 62/114, 468

(56) References Cited

U.S. PATENT DOCUMENTS 3,092,981 A 6/1963 Begeman et al.
4,476,691 A * 10/1984 Ozu ..... 137/503
4,946,611 A 8/1990 Kaneko ..... 252/78.3
5,368,765 A 11/1994 Kaneko
5,553,465 A * 9/1996 Fukuda et al. ..... 62/468
5,554,311 A * 9/1996 Katafuchi et al. ..... 252/68
5,557,944 A 9/1996 Hirano et al. ..... 62/469

FOREIGN PATENT DOCUMENTS

| | | | |
|---|---|---|---|
| EP | 0556662 | A1 | 8/1993 |
| EP | 0752532 | A1 | 1/1995 |
| EP | 0638629 | A2 | 2/1995 |
| EP | 0683321 | A1 | 11/1995 |
| EP | 0686772 | A1 | 12/1995 |
| EP | 0699742 | A2 | 3/1996 |
| JP | 62 283193 | | 12/1987 |
| JP | 1 153792 | | 6/1989 |
| JP | 324197 | | 2/1991 |
| JP | 05125374 | | 5/1993 |
| JP | 5 339592 | | 12/1993 |
| JP | 6 240272 | | 8/1994 |
| JP | 08085798 | * | 4/1996 |

* cited by examiner

*Primary Examiner*—Cephia D. Toomer
(74) *Attorney, Agent, or Firm*—Birch Stewart Kolasch & Birch LLP

(57) ABSTRACT

There are provided a refrigerating machine oil which can easily remove a sludge generated in a refrigerant circuit and is easy to return to a compressor and a refrigerator employing the same. A refrigerating machine oil obtained by mixing an alkylbenzene oil and an ether oil is employed in a refrigerant circuit. A sludge generated on an inner surface of a small-diameter portion of a capillary (4) is exfoliated and removed by the alkylbenzene oil while maintaining lubricating performance of a compressor (1) with the ether oil that is well dissolved in an HFC refrigerant, thereby preventing capillary clogging.

7 Claims, 6 Drawing Sheets

REFRIGERATING MACHINE OIL AND REFRIGERATOR USING THE SAME

This application claims the benefit under 35 U.S.C. §371 of prior PCT International Application No. PCT/JP96/03792 which has an International filing date of Dec. 25, 1996 which designated the United States of America, the entire contents of which are hereby incorporated by reference.

TECHNICAL FIELD

The present invention relates to a refrigerating machine oil comprised of a synthetic oil and a refrigerator employing the same.

BACKGROUND ART

Conventionally, an HCFC (hydrochloro-fluorocarbon) refrigerant has been mainly employed as a refrigerant of a refrigerator. However, since the HCFC refrigerant destroys the ozone layer in the atmosphere that surrounds the earth, an HFC. (hydrofluorocarbon) refrigerant having a small ozone destruction factor has been considered as a substitute for the HCFC refrigerant. HFC refrigerant hardly dissolves therein mineral oil that has conventionally been employed as a refrigerating machine oil, so that the lubricating performance of a compressor is significantly reduced. Therefore, it is proposed to employ a synthetic oil having a compatibility with the HFC refrigerant as a refrigerating machine oil.

The HFC refrigerant has an intense polarity since it has a combination of a hydrogen atom and a fluorine atom. In contrast to this, contaminations (soiled things) from deteriorated objects of cutting oil, rust preventive oil, hydraulic oil, wash oil, refrigerating machine oil and so on are nonpolar, while a synthetic oil such as an ether oil or the like has both a polar group and a nonpolar group. Therefore, the synthetic oil has a compatibility with the HFC refrigerant having a polarity and an affinity with nonpolar contaminations, therefore dissolving both of them. Then, in a compressor of the above refrigerator, the synthetic oil dissolving therein the contaminations is discharged together with the refrigerant from the compressor and made to circulate through a refrigerant circuit. When the HFC refrigerant is condensed in a condenser, the synthetic oil, which has an intense solubility in a liquid refrigerant, is dissolved in the liquid refrigerant, as a consequence of which the synthetic oil circulates through the refrigerant circuit together with the refrigerant. In this case, the affinity of the HFC refrigerant with the synthetic oil is stronger than the affinity of the contaminations with the synthetic oil, while the nonpolar contaminations are not dissolved in the HFC refrigerant having an intense polarity. Therefore, when the synthetic oil is dissolved into the liquid refrigerant, the contaminations that have been dissolved in the synthetic oil are separated from the synthetic oil and deposited in the liquid refrigerant. Then, the deposited contaminations, which have a high viscosity, adhere to narrow fluid passages of a capillary and an expansion valve, and they are eventually deposited to clog up passages.

The clogging of the capillary and the expansion valve disables the control of the refrigerant flow and causes an abnormal increase in temperature and a backward flow (return) of the fluid to the compressor, significantly impairing the reliability of the refrigerant circuit. Particularly when the ester oil is employed as the refrigerating machine oil, it causes a hydrolysis with water and tends to generate a sludge. In a refrigerator employing a capillary as a decompressor of the refrigerant circuit, the capillary tends to develop more clogging as the capillary tube has a smaller diameter, leading to a problem that it becomes inoperable as a refrigerator.

As a method for preventing the clogging of the capillary and expansion valve, it can be considered to clean the components on a strict standard, thoroughly control the setting and review components of a refrigerating system and the processing steps so that impurities do not enter during a manufacturing process and a setting process. However, these methods require much time as well as an increased number of processes as compared with the conventional cases. Furthermore, they employ an increased amount of detergent in the component cleaning stage and cause much energy consumption, consequently leading to a significant cost increase.

In contrast to this, a refrigerator which can cope with the HFC refrigerant employing only the refrigerating machine oil of the alkylbenzene oil that causes less capillary clogging has been put into practical use. However, the alkylbenzene oil, which is incompatible with the HFC refrigerant, has a property that it hardly dissolves therein the refrigerant gas. Furthermore, it is sometimes the case where a two-layer separation may be caused depending on the temperature range and the ratio of the refrigerant to the refrigerating machine oil. Accordingly, in a separate type air conditioner, an indoor unit and an outdoor unit are connected to each other by way of a long communicating pipe differently from the refrigerator in which all the components are integrated in a unit. Therefore, if the alkylbenzene oil incompatible with the HFC refrigerant is employed as the refrigerating machine oil, then the refrigerating machine oil discharged from the compressor hardly returns to the compressor since the viscosity of the refrigerating machine oil in the refrigerant circuit is high. Therefore, an air conditioner having a long communicating pipe has a problem that an abnormality occurs due to a seizure and abrasion caused by a shortage of refrigerating machine oil in the compressor.

Furthermore, when a large amount of liquid refrigerant lies in the compressor at a low environmental temperature of the compressor or when a large amount of liquid refrigerant returns to the compressor during defrosting, the refrigerating machine oil and the HFC refrigerant separate into two layers inside a dome of the compressor, as a consequence of which a refrigerant rich layer having a greater specific gravity stays in a lower portion of the dome. Then, the refrigerant rich fluid whose viscosity has been significantly reduced is consequently sucked from the inlet port of an oil pump provided in the lowermost portion of the dome of the compressor. A bearing of the compressor is normally designed on the supposition that the viscosity of the refrigerating machine oil is relatively high, according to which the size of the bearing and a frictional motive force at the bearing are considered. Therefore, if the refrigerant rich fluid whose viscosity is significantly reduced is sucked, then a thickness of oil film is reduced to cause a metal contact, and this leads to a problem that the bearing is damaged and the reliability of the compressor is significantly impaired.

DISCLOSURE OF THE INVENTION

Accordingly, it is an object of the present invention to provide a refrigerating machine oil which can easily remove a sludge generated in a refrigerant circuit without reviewing refrigerant system components nor processing steps and is easy to return to a compressor and refrigerator employing the same.

Another object of the present invention is to provide a refrigerating machine oil which can prevent a two-layer separation of oil and refrigerant into two layers inside a compressor and refrigerator employing the same.

In order to achieve the aforementioned objects, the present invention provides a refrigerating machine oil obtained by mixing a first synthetic oil comprised of an alkylbenzene oil with a second synthetic oil other than the alkylbenzene oil.

In regard to the refrigerating machine oil having the above construction, the present applicant has conducted various experiments and studies and discovered that the mixed oil obtained by mixing the first synthetic oil comprised of an alkylbenzene oil and the second synthetic oil (ether oil, ester oil, fluorine oil, carbonate oil or the like) other than the alkylbenzene oil exfoliated sludge generated on inner surfaces of refrigerant system components due to the contaminations (soiled objects) of cutting oil, rust preventive oil, hydraulic oil, wash oil and so on dissolved into a refrigerant. Therefore, according to the above refrigerating machine oil, the sludge adhered to the inner surfaces of a capillary and an expansion valve is exfoliated and removed by the alkylbenzene oil. Therefore, the sludge can be removed to prevent the capillary and the expansion valve from being clogged without reviewing the refrigerant system components nor their processing steps. By employing a synthetic oil that is easy to dissolve into an HFC refrigerant in, for example, a refrigerator employing the HFC refrigerant, the synthetic oil discharged together with the refrigerant from a compressor circulates through a refrigerant circuit and returns to the compressor. Accordingly, there is no such problem that the synthetic oil is hard to return and causes a poor lubrication, so that the lubricating performance of the compressor can be maintained.

According to the refrigerating machine oil of one embodiment, the second synthetic oil is provided by an ether oil.

With this arrangement, for example, when an HFC refrigerant is employed, the ether oil is well dissolved in the HFC refrigerant and circulates through the refrigerant circuit. Accordingly, there is no such problem that the ether oil discharged together with the refrigerant from the compressor is hard to return, so that the sludge adhered to the inner surfaces of small-diameter portions of the capillary and the expansion valve can be exfoliated and removed by the alkylbenzene oil while maintaining the lubricating performance of the compressor. The alkylbenzene oil incompatible with the HFC refrigerant is well dissolved in the ether oil, and therefore, the alkylbenzene oil is transferred to the inside of the refrigerant circuit even in a state in which the alkylbenzene oil is dissolved in the ether oil, so that the sludge can effectively be removed.

According to the refrigerating machine oil of one embodiment, the second synthetic oil is provided by an ester oil.

With this arrangement, for example, when an HFC refrigerant is employed, the ester oil is well dissolved in the HFC refrigerant and circulates through the refrigerant circuit. Accordingly, there is no such problem that the ester oil discharged together with the refrigerant from the compressor is hard to return, so that the sludge adhered to the inner surfaces of small-diameter portions of the capillary or the expansion valve can be exfoliated and removed by the alkylbenzene oil while maintaining the lubricating performance of the compressor. The alkylbenzene oil incompatible with the HFC refrigerant is well dissolved in the ester oil, and therefore, the alkylbenzene oil is transferred to the inside of the refrigerant circuit even in a state in which the alkylbenzene oil is dissolved in the ester oil, so that the sludge can effectively be removed.

According to the refrigerating machine oil of one embodiment, the second synthetic oil is comprised of an ether oil and an ester oil.

With this arrangement, for example, when an HFC refrigerant is employed, the ether oil and the ester oil are well dissolved in the HFC refrigerant and circulate through the refrigerant circuit. Accordingly, there is no such problem that the ether oil and the ester oil discharged together with the refrigerant from the compressor are hard to return, so that the sludge adhered to the inner surfaces of small-diameter portions of the capillary and the expansion valve can be exfoliated and removed by the alkylbenzene oil while maintaining the lubricating performance of the compressor. The alkylbenzene oil incompatible with the HFC refrigerant is well dissolved in the ether oil and the ester oil, and therefore, the alkylbenzene oil is transferred to the inside of the refrigerant circuit even in a state in which the alkylbenzene oil is dissolved in the ether oil and the ester oil, so that the sludge can effectively be removed. The ester oil is hydrolyzed by water but deterioration by oxidation scarcely occurs. On the contrary, the ether oil is deteriorated by oxidation but scarcely hydrolyzed by water since it withstands water. Therefore, by setting the ratio of the ether oil to the ester oil to 1:1, there can be obtained a refrigerating machine oil of which the degree of deterioration by oxidation and the degree of hydrolysis by water are each reduced half.

According to the refrigerating machine oil of one embodiment, the second synthetic oil is a fluorine oil.

With this arrangement, for example, when an HFC refrigerant is employed, the fluorine oil is well dissolved in the HFC refrigerant and circulates through the refrigerant circuit. Accordingly, there is no such problem that the fluorine oil discharged together with the refrigerant from the compressor is hard to return, so that the sludge adhered to the inner surfaces of small-diameter portions of the capillary and the expansion valve can be exfoliated and removed by the alkylbenzene oil while maintaining the lubricating performance of the compressor.

According to the refrigerating machine oil of one embodiment, the second synthetic oil is a carbonate oil.

With this arrangement, for example, when an HFC refrigerant is employed, the carbonate oil is well dissolved in the HFC refrigerant and circulates through the refrigerant circuit. Accordingly, there is no such problem that the carbonate oil discharged together with the refrigerant from the compressor is hard to return, so that, while maintaining the lubricating performance of the compressor, the sludge adhered to the inner surfaces of small-diameter portions of the capillary and the expansion valve can be exfoliated and removed by the alkylbenzene oil.

According to the refrigerating machine oil of one embodiment, the ratio of the alkylbenzene oil relative to the refrigerating machine oil is set to 1 to 50 percent by weight.

With this arrangement, the ratio of the alkylbenzene oil is preferably smaller for the synthetic oil discharged together with the refrigerant from the compressor to circulate through the refrigerant circuit and return to the compressor, whereas the ratio of the alkylbenzene oil is preferably greater for the removal of the sludge. Therefore, by making the ratio of the alkylbenzene oil as great as possible while maintaining the oil return of the synthetic oil according to the refrigerant circuit, effective sludge removal is executed. When the ratio of the alkylbenzene oil relative to the refrigerating machine oil exceeds 50 percent by weight, the ratio of the alkylbenzene oil is consequently increased too much with respect to, for example, the HFC refrigerant in which the alkylbenzene oil does not dissolve, for which the refrigerating machine oil discharged together with the refrigerant from the compressor is hard to circulate the refrigerant circuit and return. When the ratio of the alkylbenzene oil relative to the refrigerating machine oil is not greater than 50 percent by weight, the synthetic oil discharged together with the refrigerant from the compressor circulates through the refrigerant circuit and surely returns. The removal of the sludge is insufficient when the ratio of the alkylbenzene oil relative to the refrigerating machine oil is smaller than 1 percent by weight, whereas the sludge removal effect is produced when the ratio is not smaller than 1 percent by weight.

According to the refrigerating machine oil of one embodiment, the ratio of the alkylbenzene oil relative to the refrigerating machine oil is made not smaller than five percent by weight and the viscosity of the refrigerating machine oil is made not smaller than 2.5 cst at a temperature of 100° C.

According to the experiments and study conducted by the present applicant, it was discovered that the sludge generated on the inner surface of the capillary due to the contaminations of cutting oil, rust preventive oil, hydraulic oil, wash oil and so on dissolved into the refrigerant (HFC refrigerant according to the experiment) was exfoliated and surely removed when the ratio of the alkylbenzene oil relative to the refrigerating machine oil is not smaller than five percent by weight, so that the clogging of the capillary was eliminated. It was also discovered that the sludge generated on the inner surface of the capillary was not able to be removed when the ratio of the alkylbenzene oil relative to the refrigerating machine oil was smaller than five percent by weight. It was further discovered through an experiment that the ratio of metal contact becomes almost zero percent by making the viscosity of the refrigerating machine oil not smaller than 2.5 cst, so that the oil films of the bearing and so on were maintained. It was further discovered that the ratio of metal contact increases and the oil films of the bearing and so on were not sufficiently secured when the viscosity of the refrigerating machine oil was made smaller than 2.5 cst. Therefore, by making the ratio of the alkylbenzene oil relative to the refrigerating machine oil not smaller than five percent by weight and making the viscosity of the refrigerating machine oil not smaller than 2.5 cst, the clogging of the capillary and the expansion valve by the sludge can be prevented and the oil films of the bearing and so on are maintained normal throughout the entire region of the operating range, so that the reliability of the compressor can be maintained.

According to the refrigerating machine oil of one embodiment, the oil concentration of the refrigerant rich layer is made not smaller than 2.5 percent by weight when the refrigerating machine oil and the HFC refrigerant are separated into two layers at a temperature of 0° C.

With this arrangement, it was discovered through an endurance test that, when the HFC refrigerant and the refrigerating machine oil were separated into two layers inside the compressor, the oil films of the bearing and so on of the compressor were maintained appropriate and no problem has occurred when the oil concentration of the refrigerant rich layer of the layers that had separated into two layers was not smaller than 2.5 percent by weight. It was also discovered that the oil films of the bearing and so on of the compressor were reduced and the bearing and so on were damaged when the oil concentration of the refrigerant rich layer of the layers that had separated into two layers was smaller than 2.5 percent by weight. Therefore, even when the HFC refrigerant lies in the compressor in an operation stop state and the HFC refrigerant and the refrigerating machine oil are separated into two layers, the two-layer separation temperature of the HFC refrigerant and the base oil and the ratio of the alkylbenzene oil relative to the refrigerating machine oil are adjusted so that the oil concentration of the refrigerant rich layer becomes not smaller than 2.5 percent by weight. Therefore, the oil films are maintained and the bearing and so on are not damaged, so that the reliability of the compressor can be maintained. When the second synthetic oil is the ether oil, the ether oil can easily adjust the two-layer separation temperature of the HFC refrigerant and the ether oil, so that the two-layer separation temperature of the refrigerant and the mixed oil (alkylbenzene oil and ether oil) can be reduced even when an increased amount of alkylbenzene oil is incorporated therein as compared with the ester oil.

According to the refrigerating machine oil of one embodiment, the ratio of the alkylbenzene oil relative to the refrigerating machine oil is made not smaller than five percent by weight and the two-layer separation temperature of the HFC refrigerant and the refrigerating machine oil is made not higher than 10° C.

With this arrangement, when the ratio of the alkylbenzene oil relative to the refrigerating machine oil is not smaller than five percent by weight, the sludge generated on the inner surfaces of the capillary and the expansion valve due to the contaminations of cutting oil, rust preventive oil, hydraulic oil, wash oil and so on dissolved into the HFC refrigerant is exfoliated and surely removed, so that the clogging of the capillary is eliminated. According to the results of an endurance test conducted by the present applicant, it was discovered that the refrigerating machine oil and the liquid refrigerant were uniformly dissolved in an operating state at a temperature of not lower than 10° C. by making the two-layer separation temperature of the HFC refrigerant and the refrigerating machine oil not higher than 10° C. even when the liquid refrigerant returned into the dome of the compressor. It was also discovered that the refrigerating machine oil and the liquid refrigerant were sometimes not uniformly dissolved when the two-layer separation temperature of the HFC refrigerant and the refrigerating machine oil exceeded the temperature of 10° C. Therefore, by making the ratio of the alkylbenzene oil relative to the refrigerating machine oil not smaller than five percent by weight and making the two-layer separation temperature of the HFC refrigerant and the refrigerating machine oil not higher than 10° C., a mixture of the refrigerant and the mixed oil having an appropriate viscosity is sucked into an oil pump, so that the reliability of the compressor can be maintained. When the second synthetic oil is the ether oil, the ether oil can easily adjust the two-layer separation temperature of the HFC refrigerant and the ether oil, so that the two-layer separation temperature of the refrigerant and the mixed oil (alkylbenzene oil and ether oil) can be reduced even when an increased amount of alkylbenzene oil is incorporated.

The present invention also provides a refrigerator employing one of the aforementioned refrigerating machine oils.

According to the refrigerator constructed as above, the sludge adhered to the inner surfaces of the small-diameter portions of the capillary and the expansion valve is exfoliated and removed by the alkylbenzene oil, and therefore, the capillary and the expansion valve can be prevented from being clogged. Furthermore, the above arrangement can obviates the need for a refrigerant system component cleaning process for removing the cutting oil, rust preventive oil and the hydraulic oil that cause the sludge, so that the number of processes and cost can be reduced.

According to the refrigerator of one embodiment, an HFC (hydrofluorocarbon) refrigerant is employed.

With this arrangement, the sludge adhered to the inner surfaces of the small-diameter portions of the capillary and the expansion valve can be exfoliated and removed by the alkylbenzene oil although the sludge is easily generated on, in particular, the inner surfaces of the small-diameter portions of the capillary and the expansion valve when a synthetic oil having a compatibility with the HFC refrigerant is employed as a refrigerating machine oil.

According to the refrigerator of one embodiment, a capillary is employed as a decompressor.

With this arrangement, the sludge adhered to the inner surface of the small-diameter portion of the capillary is exfoliated and removed by the alkylbenzene oil. Therefore, an inexpensive capillary can be employed, so that the cost of the refrigerator can be reduced.

According to the refrigerator of one embodiment, an HFC refrigerant and a high-pressure dome type compressor are employed and the ratio of the alkylbenzene oil relative to the refrigerating machine oil is made not smaller than five percent by weight and the viscosity of the refrigerating machine oil is made not smaller than 2.5 cst at a temperature of 100° C.

According to the results of the aforementioned test and study, by making the ratio of the alkylbenzene oil relative to the refrigerating machine oil not smaller than five percent by weight and making the viscosity of the refrigerating machine oil not smaller than 2.5 cst at a temperature of 100° C., the clogging of the capillary and the expansion. valve due to the sludge can be prevented and the oil films of the bearing and so on are maintained normal throughout the entire region of the operating range, so that the reliability of the high-pressure dome type compressor having a high oil temperature can be maintained. It is to be noted that the high-pressure dome type compressor has a construction in which the refrigerant flows to a discharge pipe via an inlet pipe, a compressing portion and the container (high-pressure dome) of the compressor and the refrigerating machine oil is reserved in a high-temperature high-pressure portion inside the high-pressure dome.

According to the refrigerator of one embodiment, the oil concentration of the refrigerant rich layer when the refrigerating machine oil and the HFC refrigerant are separated into two layers at a temperature of 0° C. is made not smaller than 2.5 percent by weight.

With this arrangement, in the case where the HFC refrigerant and the refrigerating machine oil are separated into two layers inside the compressor, the oil films of the bearing and so on of the compressor are maintained appropriate when the oil concentration of the refrigerant rich layer of the layers that have separated into two layers is not smaller than 2.5 percent by weight, causing no problem in terms of the reliability. Therefore, in the case of the high-pressure dome type compressor in which the two-layer separation of the HFC refrigerant and the refrigerating machine oil is a problem, the two-layer separation temperature of the HFC refrigerant and the base oil and the ratio of the alkylbenzene oil relative to the refrigerating machine oil are adjusted so that the oil concentration of the refrigerant rich layer becomes not smaller than 2.5 percent by weight even when the HFC refrigerant lies in the compressor in the operation stop state and the HFC refrigerant and the refrigerating machine oil are separated into two layers. Therefore, the oil films are maintained to cause no damage of the bearing and so on, so that the reliability of the compressor can be maintained. When the second synthetic oil is the ether oil, the ether oil can easily adjust the two-layer separation temperature of the HFC refrigerant and the ether oil, so that the two-layer separation temperature of the refrigerant and the mixed oil (alkylbenzene oil and ether oil) can be reduced even when an increased amount of alkylbenzene oil is incorporated therein as compared with the ester oil.

According to the refrigerator of one embodiment, an HFC refrigerant and a low-pressure dome type compressor are employed, the ratio of the alkylbenzene oil relative to the refrigerating machine oil is made not smaller than five percent by weight and the two-layer separation temperature of the HFC refrigerant and the refrigerating machine oil is made not higher than 10° C.

With this arrangement, according to the results of the aforementioned test and study, when the ratio of the alkylbenzene oil relative to the refrigerating machine oil is not smaller than five percent by weight, the sludge generated on the inner surface of the capillary due to the contaminations of cutting oil, rust preventive oil, hydraulic oil, wash oil and so on dissolved into the HFC refrigerant is exfoliated and surely removed, so that the clogging of the capillary and the expansion valve is eliminated. In the case of the low-pressure dome type compressor in which the two-layer separation of the HFC refrigerant and the refrigerating machine oil tends to occur, the ratio of the alkylbenzene oil must be reduced as compared with the high-pressure dome type. By making the two-layer separation temperature of the HFC refrigerant and the refrigerating machine oil not higher than 10° C., the refrigerating machine oil and the liquid refrigerant are uniformly dissolved in an operating state at a temperature of not lower than 10° C. by making the two-layer separation temperature of the HFC refrigerant and the refrigerating machine oil not higher than 10° C. even when the liquid refrigerant returned into the dome of the compressor. Therefore, by making the ratio of the alkylbenzene oil relative to the refrigerating machine oil not smaller than five percent by weight and making the two-layer separation temperature of the HFC refrigerant and the refrigerating machine oil not higher than 10° C., a mixture of the refrigerant and the mixed oil having an appropriate viscosity is sucked into the oil pump, so that the reliability of the low-pressure dome type compressor can be maintained. It is to be noted that the low-pressure dome type compressor has a construction in which the refrigerant flows to a discharge pipe via an inlet pipe, the container (low-pressure dome) of the compressor and a compressing portion and the refrigerating machine oil is reserved in a low-temperature low-pressure portion inside the low-pressure dome. When the second synthetic oil is the ether oil, the ether oil can easily adjust the two-layer separation temperature of the HFC refrigerant and the ether oil, so that the two-layer separation temperature of the refrigerant and the mixed oil (alkylbenzene oil and ether oil) can be reduced even when an increased amount of alkylbenzene oil is incorporated therein as compared with the ester oil.

According to the refrigerator of one embodiment, an HCFC refrigerant is employed.

With this arrangement, the sludge adhered to the inner surfaces of the small-diameter portions of the capillary and the expansion valve can be exfoliated and removed by the alkylbenzene oil although the sludge is easily generated on, in particular, the inner surfaces of the small-diameter portions of the capillary and the expansion valve when a synthetic oil is employed as a refrigerating machine oil.

According to the refrigerator of one embodiment, an HCFC refrigerant is employed and a capillary is employed for its decompressor.

With this arrangement, the refrigerating machine oil also has a compatibility with the HCFC refrigerant, and the sludge adhered to the inner surface of the small-diameter portion of the capillary can be exfoliated and removed by the alkylbenzene oil mixed in the refrigerating machine oil. Since the sludge adhered to the inner surface of the small-diameter portion of the capillary is exfoliated and removed by the alkylbenzene oil, an inexpensive capillary can be employed, so that the cost of the refrigerator can be reduced. The refrigerator filled with the above refrigerating machine oil can easily replace the HCFC refrigerant with the alternative refrigerant of the HFC refrigerant (so-called the retrofit can easily be achieved) without changing the refrigerating machine oil.

According to the refrigerator of one embodiment, an HCFC refrigerant and a high-pressure dome type compressor are employed, the ratio of the alkylbenzene oil relative to the refrigerating machine oil is made not smaller than five percent by weight and the viscosity of the refrigerating machine oil is made not smaller than 2.5 cst at a temperature of 100° C.

With this arrangement, according to the results of the aforementioned test and study, by making the ratio of the alkylbenzene oil relative to the refrigerating machine oil not smaller than five percent by weight and making the viscosity of the refrigerating machine oil not smaller than 2.5 cst at a temperature of 100° C., the clogging of the capillary and the expansion valve by the sludge can surely be prevented and the oil films of the bearing and so on are maintained normal throughout the entire region of the operating range, so that the reliability of the high-pressure dome type compressor having a high oil temperature can be maintained. The refrigerator filled with the above refrigerating machine oil can easily replace the HCFC refrigerant with the alternative refrigerant of the HFC refrigerant without changing the refrigerating machine oil.

According to the refrigerator of one embodiment, the oil concentration of the refrigerant rich layer is made not smaller than 2.5 percent by weight when the refrigerating machine oil and the HCFC refrigerant are separated into two layers at a temperature of 0° C.

With this arrangement, in the case where the HFC refrigerant and the refrigerating machine oil are separated into two layers inside the compressor, the oil films of the bearing and so on of the compressor are maintained appropriate when the oil concentration of the refrigerant rich layer of the layers that have separated into two layers is not smaller than 2.5 percent by weight, causing no problem in terms of the reliability. Therefore, in the case of the high-pressure dome type compressor in which the two-layer separation of the HCFC refrigerant and the refrigerating machine oil is a problem, the two-layer separation temperature of the HCFC refrigerant and the base oil and the ratio of the alkylbenzene oil relative to the refrigerating machine oil are adjusted so that the oil concentration of the refrigerant rich layer becomes not smaller than 2.5 percent by weight even when the HCFC refrigerant lies in the compressor in the operation stop state and the HCFC refrigerant and the refrigerating machine oil are separated into two layers. Therefore, the oil films are maintained to cause no damage of the bearing and so on, so that the reliability of the compressor can be maintained. The refrigerator filled with the above refrigerating machine oil can easily replace the HCFC refrigerant with the alternative refrigerant of the HFC refrigerant without changing the refrigerating machine oil. When the second synthetic oil is the ether oil, the ether oil can easily adjust the two-layer separation temperature of the HFC refrigerant and the ether oil, so that the two-layer separation temperature of the refrigerant and the mixed oil (alkylbenzene oil and ether oil) can be reduced even when an increased amount of alkylbenzene oil is incorporated as compared with the ester oil.

According to the refrigerator of one embodiment, an HCFC refrigerant and a low-pressure dome type compressor are employed, the ratio of the alkylbenzene oil relative to the refrigerating machine oil is made not smaller than five percent by weight and the two-layer separation temperature of the refrigerating machine oil and the HCFC refrigerant is made not higher than 10° C.

With this arrangement, according to the results of the aforementioned test and study, when the ratio of the alkylbenzene oil relative to the refrigerating machine oil is not smaller than five percent by weight, the sludge generated on the inner surface of the capillary due to the contaminations of cutting oil, rust preventive oil, hydraulic oil, wash oil and so on dissolved into the HCFC refrigerant is exfoliated and surely removed, so that the clogging of the capillary is eliminated. In the case of the low-pressure dome type compressor in which the two-layer separation of the HCFC refrigerant and the refrigerating machine oil tends to occur, by making the two-layer separation temperature not higher than 10° C., the refrigerating machine oil and the liquid refrigerant are uniformly dissolved in an operating state at a temperature not lower than 10° C. even when the liquid refrigerant returns to the inside of the dome of the compressor. Therefore, a mixture of the refrigerant and the refrigerating machine oil having an appropriate viscosity is sucked into the oil pump, so that the reliability of the low-pressure dome type compressor can be maintained. The refrigerator filled with the above refrigerating machine oil can easily replace the HCFC refrigerant with the alternative refrigerant of the HFC refrigerant without changing the refrigerating machine oil. When the second synthetic oil is the ether oil, the ether oil can easily adjust the two-layer separation temperature of the HFC refrigerant and the ether oil, so that the two-layer separation temperature of the refrigerant and the mixed oil (alkylbenzene oil and ether oil) can be reduced even when an increased amount of alkylbenzene oil is incorporated as compared with the ester oil.

According to the refrigerator of one embodiment, there are employed a swing type compressor comprising: a roller which is rotatably fitted on an eccentric section of a driving shaft; a blade which is integrally fixed to an outer peripheral surface of the roller and extends outwardly of a radius of the roller, thereby separating a cylinder chamber inside a cylinder into a compression chamber and an inhalation chamber; and a support member which is rotatably supported in the cylinder and in which is formed a reception groove that receives and guides a protruding side tip portion of the blade.

According to the refrigerator constructed as above, in the swing type compressor, the blade is fixed to the roller and the tip portion of the blade is guided by the reception groove of the rotatable support member. Therefore, the surface of the blade comes in surface contact with the support member to achieve sealing, generating no boundary lubrication state.

Therefore, even when the alternative fleon refrigerant is employed taking the environmental safety into consideration, the sludge adhered to the inner surfaces of the small-diameter portions of the capillary and the expansion valve can be exfoliated and removed by the alkylbenzene oil. Furthermore, the blade of the compressor is made to slide in surface contact with the support member, and therefore, the deterioration of the lubricating oil can be prevented, so that the seizure can be prevented.

BEST MODE FOR CARRYING OUT THE INVENTION

Figure 1:
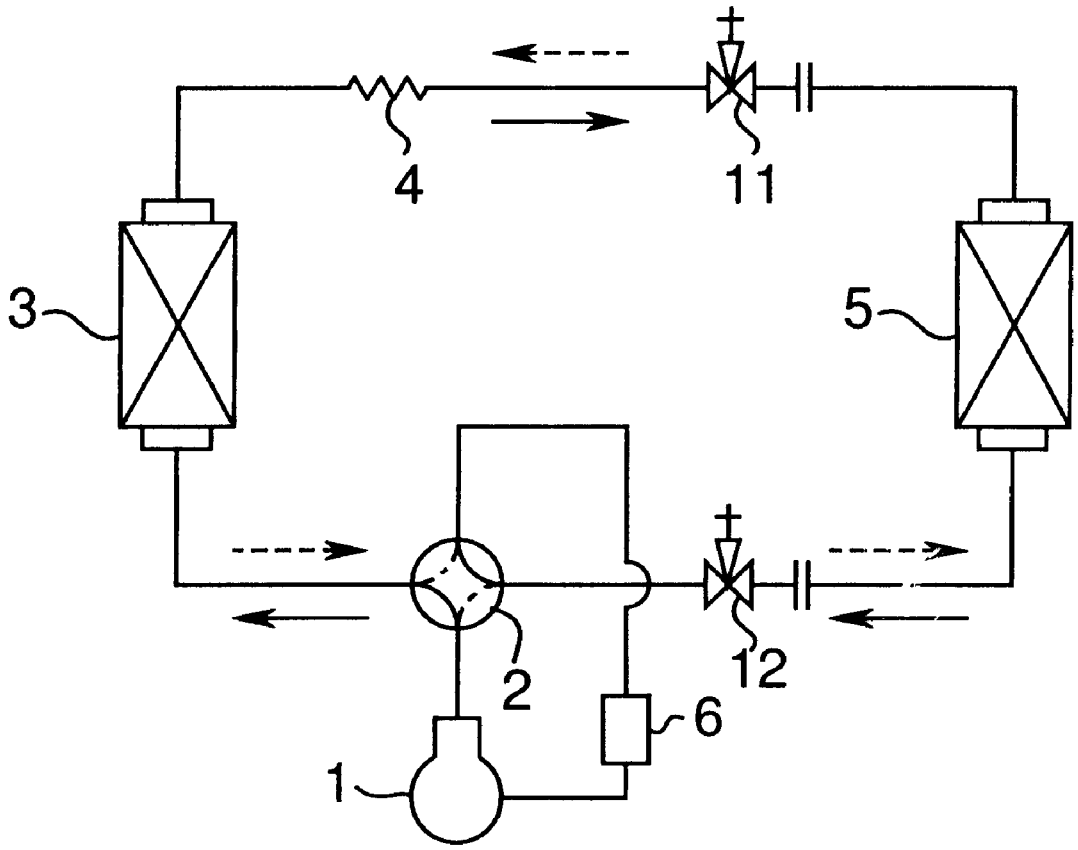
FIG. 1 is a circuit diagram of a refrigerator employing a refrigerating machine oil according to first and second embodiments of the present invention.

The following will describe in detail experiments and study concerning refrigerating machine oil of the present invention as well as a refrigerator employing the refrigerating machine oil on the embodiments shown in the drawings.

First, the present applicant prepared for experiments by operating a refrigerator which employs a synthetic oil (ester oil, for example) as a refrigerating machine oil for a long term, clogging a capillary with a sludge generated on an inner surface of the capillary with contaminations (soiled objects) of cutting oil, rust preventive oil, hydraulic oil, wash oil and so on dissolved into a refrigerant and cutting the capillary for the preparation of a plurality of samples. Then, by immersing for a long term the plurality of samples clogged with the sludge generated on the inner surface into mixed oils obtained by incorporating an alkylbenzene oil which serves as a first synthetic oil into each of an ether oil, an ester oil and a fluorine oil which serve as a second synthetic oil, the change in state of the sludge of each sample was observed. As a result, by incorporating the alkylbenzene oil into the base oils of the ether oil, ester oil and the fluorine oil, it was discovered that there was the effect of exfoliating the sludge generated on the inner surfaces of refrigerant system components due to the contaminations (soiled objects) of cutting oil, rust preventive oil, hydraulic oil, wash oil and so on dissolved into the refrigerant.

Furthermore, as a result of conducting the experiment of immersing for a 10 ng term the samples into only the alkylbenzene oil, it was discovered that the alkylbenzene oil singly had the effect of exfoliating the sludge, or the cause of the clogging of the capillary and cleaning the inner surface of the capillary. The samples of the above experiment had come to have a lustered inner surface state similar to a new one differently from the case where the ether oil, ester oil or a mineral oil was used. However, if the alkylbenzene oil is employed as a refrigerating machine oil, then the alkylbenzene oil is incompatible with the HFC refrigerant, and therefore, the refrigerating machine oil discharged together with the refrigerant from the compressor does not return to the compressor without circulating through the refrigerant circuit in a refrigerator having a long piping or a great difference of elevation, and this leads to a reduction in reliability due to a poor lubrication.

Accordingly, based on the results of the above experiment, the present applicant decided to concurrently employ an alkylbenzene oil and a synthetic oil (ether oil, ester oil, fluorine oil, carbonate oil and so on) having a compatibility with the HFC refrigerant. That is, lubricating performance of the compressor is maintained by making satisfactory oil return with the synthetic oil that is well dissolved in the HFC refrigerant and the sludge causing the clogging of the capillary is removed by incorporating the alkylbenzene oil into the synthetic oil. Thus, the aforementioned problems of the poor lubrication and the clogging of the capillary can be resolved at once.

First Embodiment

The following will describe the case where the above refrigerating machine oil is employed in the refrigerator.

FIG. 1 is a circuit diagram of a refrigerator employing the above refrigerating machine oil, the refrigerator including a compressor 1, a four-way valve 2 connected to the outlet side of the compressor 1, an outdoor heat exchanger 3 whose one end is connected to the four-way valve 2, a capillary 4 which serves as an expanding means whose one end is connected to the other end of the outdoor heat exchanger 3, an indoor heat exchanger 5 whose one end is connected to the other end of the capillary 4 via a shutoff valve 11 and an accumulator 6 of which the one end is connected to the other end of the indoor heat exchanger 5 via a shutoff valve 12 and the four-way valve 2 and the other end is connected to the inlet side of the compressor 1.

In the refrigerator constructed as above, an HFC refrigerant (R-134a, R-407, R-410, HFC-32/134a or the like) is employed as a substitute refrigerant for the HCFC refrigerant, while a mixed oil obtained by mixing any one of the ether oil, ester oil, fluorine oil and carbonate oil with an alkylbenzene oil is employed as a refrigerating machine oil. The ratio of the alkylbenzene oil is set within a range of 1 to 50 percent by weight relative to the whole refrigerating machine oil according to the refrigerant circuit and so on.

The sludge adhered to the inner surface of the small-diameter portion of the capillary 4 is exfoliated and removed by the alkylbenzene oil mixed in the refrigerating machine oil, and therefore, the clogging of the capillary can be prevented without reviewing the refrigerant system components nor the processing steps. Furthermore, the above arrangement can obviates the need for a refrigerant system component cleaning process for removing the cutting oil, rust preventive oil, the hydraulic oil and the like which cause the sludge, and therefore, the number of processes and cost can be reduced.

When a synthetic oil (ether oil, ester oil, fluorine oil, carbonate oil or the like) incompatible with an HFC refrigerant is employed in a refrigerant circuit employing the HFC refrigerant, the synthetic oil is well dissolved in the HFC refrigerant to circulate through the refrigerant circuit. Accordingly, there is no such problem that the synthetic oil discharged from the compressor 1 is hard to return, so that the lubricating performance of the compressor 1 can be maintained. When the synthetic oil is employed, particularly a sludge tends to be generated. However, the sludge adhered to the inner surfaces of the small-diameter portions of the refrigerant system components such as the capillary 4 can be exfoliated and removed by the alkylbenzene oil mixed in the refrigerating machine oil. Furthermore, the alkylbenzene oil is well dissolved in the ether oil and the ester oil, so that the alkylbenzene oil is transferred into the refrigerant circuit in a state in which the alkylbenzene oil is dissolved in the ether oil and the ester oil, thereby allowing the sludge to be effectively removed.

Furthermore, the sludge adhered to the inner surface of the small-diameter portion of the capillary 4 is exfoliated and removed by the refrigerating machine oil obtained by mixing the alkylbenzene oil with another synthetic oil. Accordingly, there is no concern about the clogging of the capillary, so that an inexpensive capillary can be employed. Therefore, the cost of the refrigerator can be reduced. Furthermore, by employing the above capillary, the reliability of the refrigerator can be improved.

Furthermore, the present applicant carried out experiments on various conditions about the refrigerating machine oil scarcely causing, capillary clogging and causing no impairment of the reliability of the compressor, and consequently discovered that a mixed oil obtained by mixing a first synthetic oil comprised of an alkylbenzene oil into a second synthetic oil comprised of an ether oil or ester oil at an appropriate ratio was able to solve these problems. The following will describe the detail of the above as well as a second embodiment of the refrigerator which employs the mixed oil as a refrigerating machine oil.

Table 1 shows the results of immersion experiments and real machine endurance test conducted with synthetic oils of an ether oil and an ester oil employed as a base oil and with the ratio of the alkylbenzene oil changed.

TABLE 1

| | Ratio of alkylbenzene oil (wt %) | | | | | |
|---|---|---|---|---|---|---|
| | 0 | 3 | 5 | 10 | 30 | 50 |
| Immersion experiment I | x | x | ○ | ○ | ○ | ○ |
| Immersion experiment II | x | x | ○ | ○ | ○ | ○ |
| Real machine endurance test | x | — | ○ | — | — | ○ |

In Table 1, the test conditions and so on of the immersion experiment I, the immersion experiment II and the real machine endurance test are as follows.

Immersion Experiment I

Base oil: Ether oil

The capillary to the inner surface of which sludge is adhered is immersed at normal temperature for two weeks.

O: The sludge is exfoliated.

x: The sludge is not exfoliated.

Immersion Experiment II

Base oil: Ester oil

The capillary to the inner surface of which sludge is adhered is immersed at normal temperature for two weeks.

O: The sludge is exfoliated.

x: The sludge is not exfoliated.

Real Machine Endurance Test

Test machine: Room air conditioner (1 hp)

Refrigerant: R-407C

Base oil: Ester oil

The presence or absence of sludge is decided after an elapse of 4000 hours of operation.

O: The capillary is not clogged.

x: The capillary is clogged.

According to the above immersion experiments I and II, a clogged capillary piece through the real machine endurance test of an ester oil was immersed in a mixed oil, and a change of sludge was visually observed to check whether or not the sludge adhered to the inner surface of the capillary was exfoliated. According to the real machine endurance test, the endurance test was executed by filling the real machine having a capillary with the mixed oil and mixing a specified amount of contamination. Then, nitrogen gas was flowed under a specified pressure difference condition with the capillary removed every specified time, and the flow rate was measured for the evaluation of the capillary clogging depending on the presence or absence of a reduction in flow rate. That is, it is determined that the sludge is adhered to the inner surface of the capillary when the nitrogen flow rate is reduced and no sludge is adhered to the inner surface of the capillary when the nitrogen flow rate is not reduced.

The results of the immersion experiments I and II and the result of the real machine endurance test well conformed to each other, consequently discovering that the sludge on the inner surface of the capillary was able to be exfoliated and securely removed and the affinity of the refrigerating machine oil with the contamination was maintained, consequently depositing no contamination in the liquid refrigerant when the ratio of the alkylbenzene oil relative to the refrigerating machine oil comprised of the first synthetic oil of the alkylbenzene oil and the second synthetic oil (ether oil or ester oil) other than it was not smaller than five percent by weight. It is to be noted that the same result is also obtained when a mixed oil comprised of the ether oil and the ester oil, the fluorine oil or the carbonate oil is employed as the second synthetic oil.

Furthermore, in a mixed oil obtained by mixing an alkylbenzene oil into a synthetic oil (ether oil or ester oil) having a compatibility with the HFC refrigerant, a two-layer separation temperature at which the HFC refrigerant and the mixed oil are separated into two layers is significantly influenced by the ratio of the alkylbenzene oil.

Figure 2:
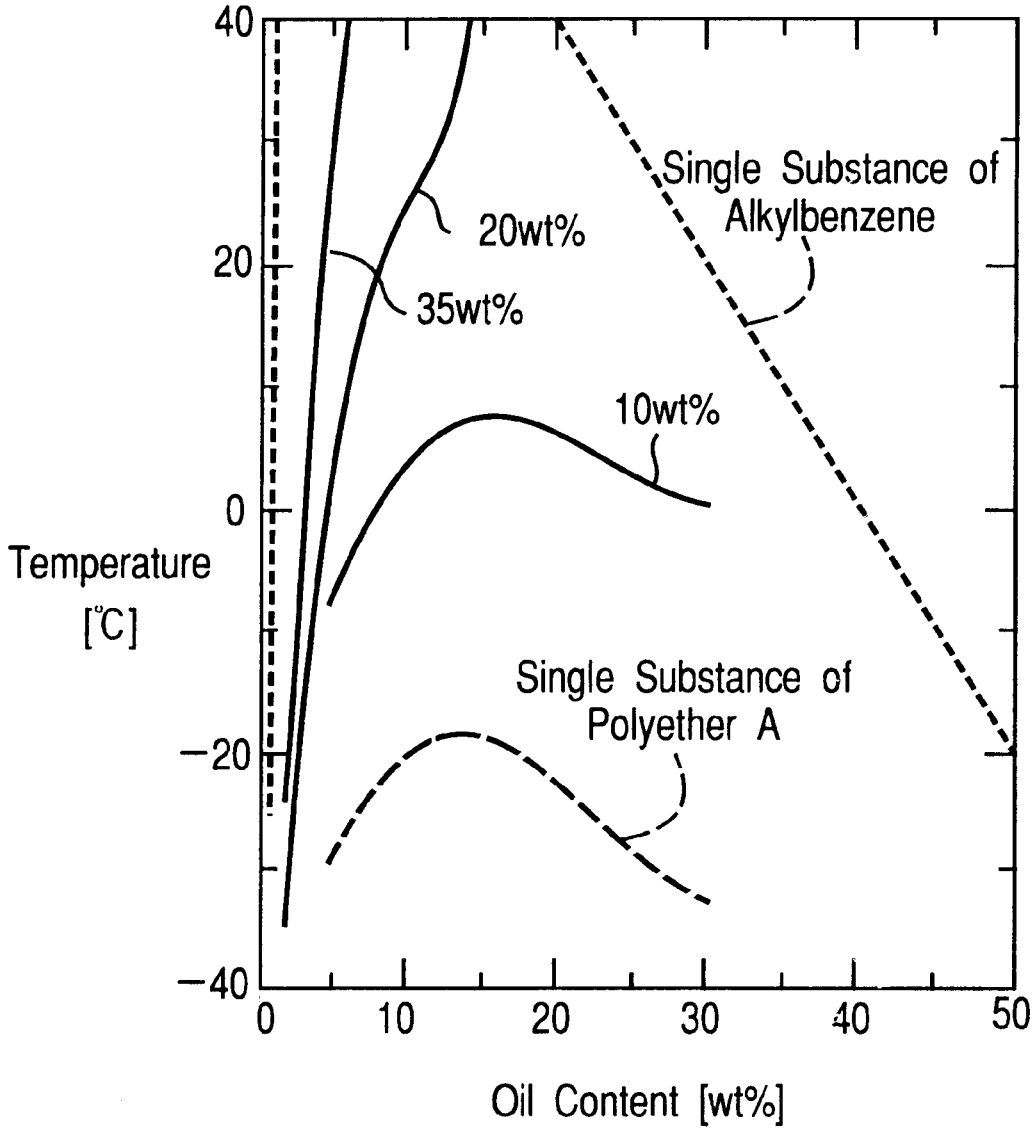
FIG. 2 is a graph showing two-layer separation of an HFC refrigerant R-407C and a mixed oil (alkylbenzene and polyether A)
Figure 3:
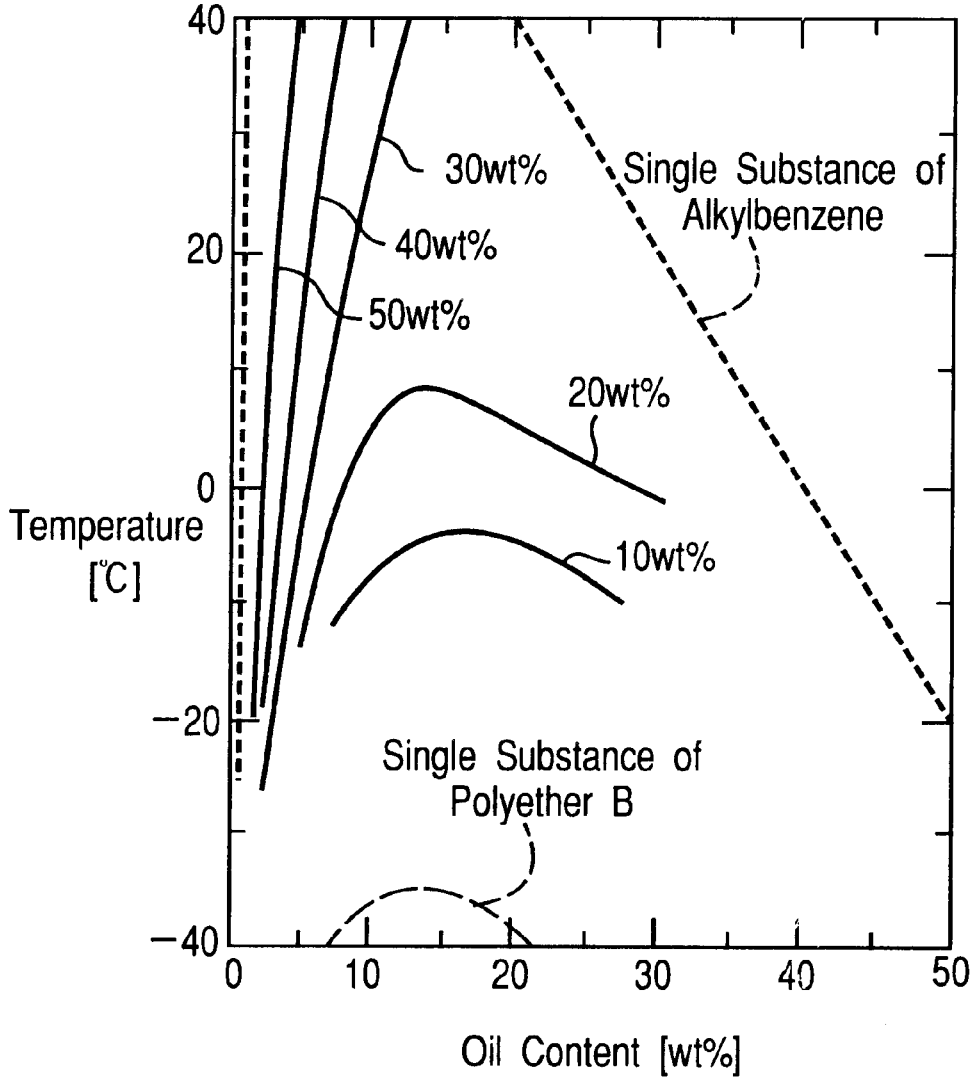
FIG. 3 is a graph showing two-layer separation of an HFC refrigerant R-407C and a mixed oil (alkylbenzene and polyether B)

Paying attention to this point, the present applicant carried out a test of the characteristic of the two-layer separation of the HFC refrigerant R-407C and the mixed oil. The results are shown in FIG. 2 and FIG. 3. A mixed oil of an alkylbenzene oil and a polyether A (ether oil) was employed as the refrigerating machine oil in the test of FIG. 2, while a mixed oil of an alkylbenzene oil and a polyether B (ether oil) was employed as the refrigerating machine oil in the test of FIG. 3. The two-layer separation temperature of the HFC refrigerant R-407C and a single substance of the polyether A was set to about −20° C. in the case of FIG. 2, while the two-layer separation temperature of the HFC refrigerant R-407C and a single-element substance of the polyether B was set to about −35° C. in the case of FIG. 3. In FIG. 2 and FIG. 3, the HFC refrigerant R-407C and the single substance of the alkylbenzene oil were separated into two layers in any temperature range, and the so-called lower critical solution temperature does not appear.

As the ratio of the alkylbenzene oil is increased by incorporating an increased amount of alkylbenzene oil into the base oil of the polyether A and B, the two-layer separation temperature of the HFC refrigerant and the mixed oil rises more significantly. For example, when about 11 percent by weight of alkylbenzene oil is incorporated in the case of FIG. 2, the two-layer separation temperature changes from about −20° C. to about 10° C., which is increased by about 30° C. as compared with the polyether A. On the other hand, when about 21 percent by weight of alkylbenzene oil is incorporated in the case of FIG. 3, the two-layer separation temperature changes from about −35° C. to about 10° C., meaning that the two-layer separation temperature becomes totally low in the case where the ratio of the alkylbenzene oil is identical as compared with the case of FIG. 2.

As described above, as the two-layer separation temperature of the HFC refrigerant and the single substance of the base oil becomes lower, the two-layer separation temperature of the HFC refrigerant and the mixed oil can be made lower according to it. Then, by lowering the two-layer separation temperature of the HFC refrigerant and the mixed oil, the refrigerating machine oil and the liquid refrigerant are uniformly incorporated in an operating state in which the oil temperature inside the compressor has risen even when the liquid refrigerant returns to the inside of the dome of the compressor, and a mixture of the refrigerating machine oil and the refrigerant having an appropriate viscosity is sucked into an oil pump, so that the lubrication of the bearing and so on of the compressor can be maintained normal. Particularly in the low-pressure dome type compressor having an oil temperature lower than that of the high-pressure dome type, the liquid refrigerant is to be directly mixed with the refrigerating machine oil, and therefore, a refrigerating machine oil having a lower two-layer separation temperature of the HFC refrigerant and the mixed oil is needed.

The ether oil has a feature that it can adjust the two-layer separation temperature of the HFC refrigerant and the ether oil. Therefore, when intending to provide a mixed oil having a low two-layer separation temperature, it is preferable to employ as a base oil an ether oil capable of making the two-layer separation temperature lower than that of the ester oil.

From the results of aforementioned test and study, the proper ratio of the alkylbenzene oil for resolving the conventional problems was searched. That is, the ratio of the alkylbenzene oil relative to the refrigerating machine oil was searched so as to satisfy the required conditions that:

i) neither a capillary nor an expansion valve is clogged; and ii) the reliability of the compressor is not impaired even in a state in which the liquid refrigerant returns to the compressor or the refrigerating machine oil comes to have a high temperature.

Figure 4:
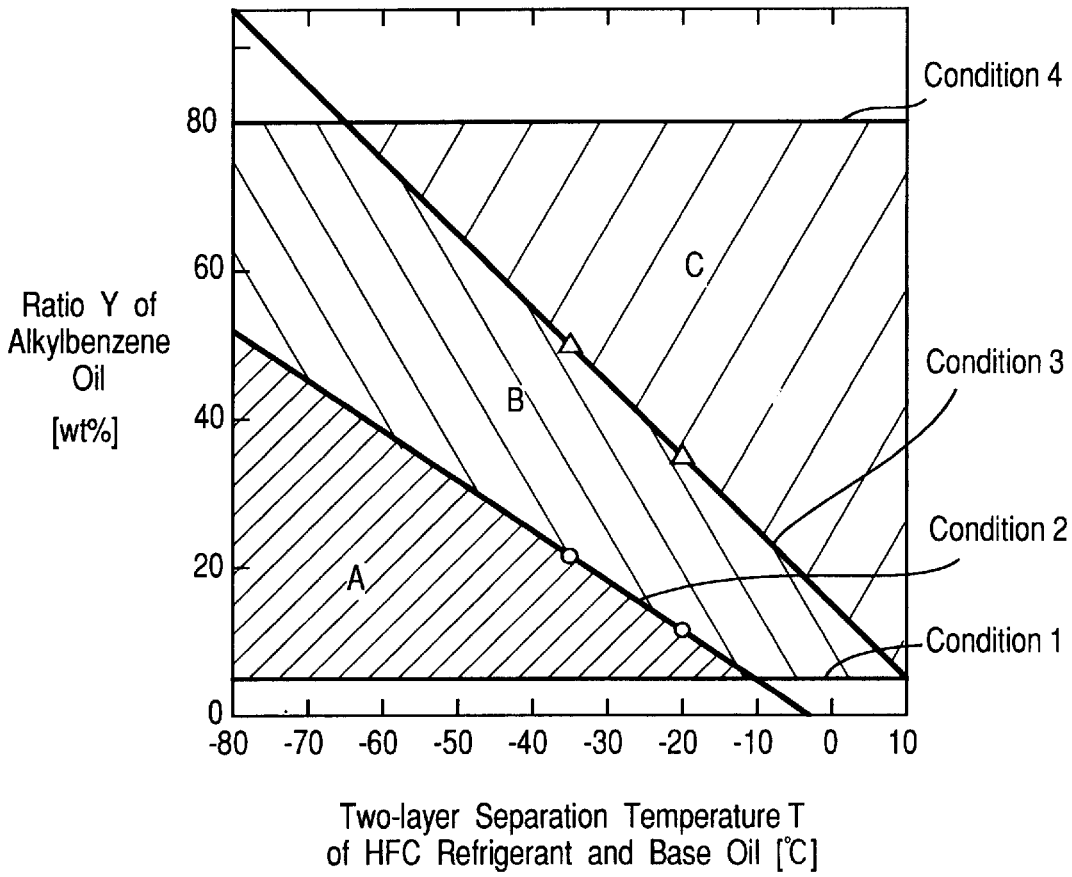
FIG. 4 is a graph showing a relation between a two-layer separation temperature of an HFC refrigerant and a base oil and a ratio of an alkylbenzene oil.

FIG. 4 shows the results of the search, where the axis of abscissas represents the two-layer separation temperature T of the HFC refrigerant and the base oil and the axis of ordinates represents the ratio Y of the alkylbenzene oil.

First, from Table 1, the condition of the ratio Y of the alkylbenzene oil is:

$$Y \geqq 5 \qquad \text{[Condition 1]}$$

The two-layer separation easily occurs in the low-pressure dome type compressor, and therefore, it is required to make the ratio of the alkylbenzene oil lower than in the high-pressure dome type. As a result of carrying out an endurance test of the compressor, it was discovered that the reliability of the compressor was able to be secured when the two-layer separation temperature of the HFC refrigerant and the mixed oil is not higher than 10° C. It was also discovered that the reliability of the compressor was not able to be sufficiently secured when the two-layer separation temperature of the HFC refrigerant and the mixed oil exceeded 10° C. The two-layer separation temperature is about 10° C. in the case of the conventional combination of the HCFC refrigerant and the mineral oil (Suniso 4GS: tradename), and according to this achievement, the two-layer separation temperature of 10° C. of the HFC refrigerant and the mixed oil is the proper value. Accordingly, the ratio of the alkylbenzene oil at the two-layer separation temperature of 10° C. was obtained from the data shown in FIG. 2 and FIG. 3, and the ratio was indicated by o marks in FIG. 4. Therefore, as shown in FIG. 4, the condition of the ratio Y of the alkylbenzene oil relative to the two-layer separation temperature T of the HFC refrigerant and the base oil at which the two-layer separation temperature of the HFC refrigerant and the mixed oil becomes not higher than 10° C. is:

$$Y \leqq -0.67T-3 \qquad \text{[Condition 2]}$$

Furthermore, in the high-pressure dome type compressor having a high oil temperature in the normal operating state, the two-layer separation scarcely occurs even when the ratio of the alkylbenzene oil is increased. However, in a stop state, the oil temperature is reduced to the environmental temperature, and the refrigerant moves into the dome, causing so-called the lie-up. In this state, the two-layer separation of the HFC refrigerant and the mixed oil occurs. As a result of carrying out an endurance test supposing this lie-up, it was discovered that the oil films of the bearing and so on of the compressor were maintained and no problem occurs in terms of the reliability when the oil concentration of the refrigerant rich layer of the layers that are separated into two layers was not smaller than 2.5 percent by weight (at a temperature of 0° C.). It was also discovered that the oil films of the bearing and so on of the compressor became thin to cause damage of the bearing and so on when the oil concentration of the refrigerant rich layer of the layers that are separated into two layers was smaller than 2.5 percent by weight (at a temperature of 0° C.). Accordingly, the ratio of the alkylbenzene oil relative to the refrigerating machine oil when the oil content at the temperature of 0° C. was 2.5 percent by weight was obtained from the data of FIG. 2 and FIG. 3, and the ratio was indicated by o marks in FIG. 4. Therefore, as shown in FIG. 4, the condition of the ratio Y of the alkylbenzene oil relative to the two-layer separation temperature T of the HFC refrigerant and the base oil is:

$$Y \leqq -T+15 \qquad \text{[Condition 3]}$$

It is to be noted that the above [Condition 3] is in the case of the high-pressure dome type in which the two-layer separation becomes a problem, and this [Condition 3] is not required to be satisfied in the case where the amount of refrigerant is small although the machine is specially designed for both cooling and heating or cooling only or in the case where the compressor is provided with a two-layer separation preventing function.

Figure 5:
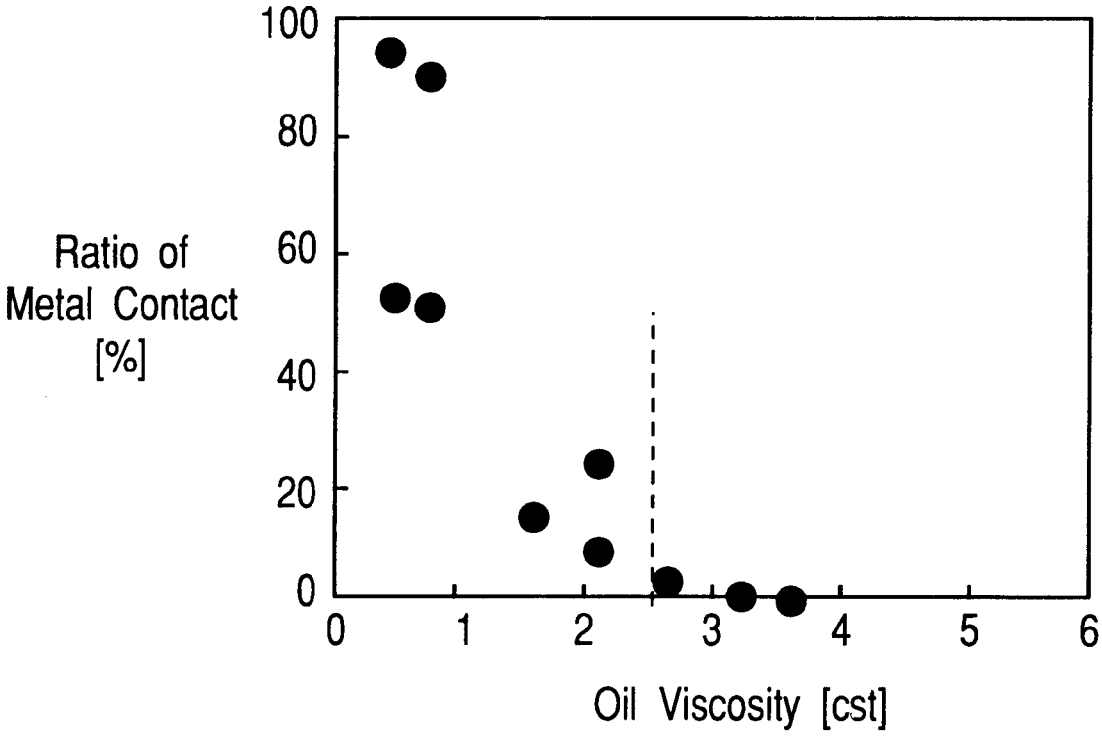
FIG. 5 is a graph showing a ratio of metal contact relative to an oil viscosity.

FIG. 5 shows the result of the test of examining a relation of the ratio of metal contact relative to the oil viscosity at an oil temperature of 90 to 110° C. during operation of the high-pressure dome type compressor. As shown in FIG. 5, although there is a variation depending on the operating conditions, the ratio of metal contact becomes approximately zero percent when the oil viscosity is not smaller than 2.5 cst, and this discovers that the oil films of the bearing and so on of the compressor are maintained. If the oil viscosity is smaller than 2.5 cst, the ratio of metal contact increases and the oil films of the bearing and so on of the compressor become thin, and this discovers that the bearing and so on are damaged to impair the reliability. Therefore, when the operating condition of a high oil temperature is taken into consideration, the oil films of the bearing are maintained normal throughout the entire region of the operating range of the product when the viscosity of the refrigerating machine oil is not smaller than 2.5 cst at an oil temperature of 100° C. The condition of the ratio Y of the alkylbenzene oil obtained on the basis of a rule of mixture and the condition that the viscosity of the refrigerating machine oil is not smaller than 2.5 cst and the viscosity is:

$$Y \leqq (\log\log(2.5+0.6)-\log\log(U+0.6))/(\log\log(V+0.6)-\log\log(U+0.6))\times 100 \quad \text{[Condition 4]}$$

In the above [Condition 4], U represents the viscosity [cst] of the base oil at a temperature of 100° C., while V represents the viscosity [cst] of the alkylbenzene oil at a temperature of 100° C. The above rule of mixture prescribes the volume ratio, and therefore, it is to be calculated on the assumption that the concentrations of the base oil and the alkylbenzene oil are identical in converting it into the weight ratio. Therefore, when the densities of the base oil and the alkylbenzene oil differ from each other, they are to be corrected. The boundary line of the [Condition 4] shown in FIG. 4 is in the case where the grade of viscosity of the base oil is VG68 (viscosity is 68 [cst] at a temperature of 40° C.) and the grade of viscosity of the alkylbenzene oil is VG8 (viscosity is [cst] at a temperature of 40° C.).

Second Embodiment

The following will describe the case where a refrigerating machine oil satisfying the aforementioned [Condition 1] through [Condition 4] is employed in a refrigerator.

In a refrigerator having the same construction as that of the refrigerator of the first embodiment shown in FIG. 1, an HFC refrigerant and a high-pressure dome type compressor 1 are employed, and a refrigerating machine oil obtained by mixing the alkylbenzene oil of ratios satisfying the aforementioned [Condition 1] and [Condition 4] (indicated in the regions A, B and C in FIG. 4) into a base oil (ether oil) is employed. In this case, no clogging occurs in the capillary 4 and the oil films of the bearing and so on are maintained normal throughout the entire region of the operating range, so that the reliability of the high-pressure dome type compressor 1 having a high oil temperature can be maintained.

In the case where the compressor 1 is the high-pressure dome type in which the two-layer separation is a problem, a refrigerating machine oil obtained by mixing the alkylbenzene oil of ratios satisfying the [Condition 3] in addition to the [Condition 1] and [Condition 4] (indicated in the regions A and B in FIG. 4) into a base oil (ether oil) is employed. In this case, the clogging of the capillary 4 is prevented and the oil concentration of the refrigerant rich layer is made not smaller than 2.5 percent by weight even when the refrigerant is separated into two layers in an operation stop state due to the lie-in or the like. Therefore, the oil films are maintained to prevent the bearing and so on from being damaged, so that the reliability of the high-pressure dome type compressor 1 can be improved.

In the case where the compressor 1 is the low-pressure dome type in which the two-layer separation easily occurs, a refrigerating machine oil obtained by mixing the alkylbenzene oil of ratios satisfying the [Condition 1] and [Condition 2] (indicated in the region A in FIG. 4) into a base oil (ether oil) is employed. That is, by reducing the ratio of the alkylbenzene oil as compared with the high-pressure dome type to thereby make the two-layer separation temperature of the HFC refrigerant and the mixed oil not higher than 10° C., the mixed oil and the liquid refrigerant are uniformly dissolved even when the liquid refrigerant returns to the inside of the dome of the compressor 1 in an operating state in which the oil temperature is not lower than 10° C., so that the mixture of the refrigerant and the mixed oil having an appropriate viscosity is sucked into the oil pump. Therefore, the reliability of the low-pressure dome type compressor 1 can be maintained.

In the aforementioned second embodiment, the alkylbenzene oil is well dissolved in the ether oil, and the ether oil can easily adjust the two-layer separation temperature of the HFC refrigerant and the ether oil. Therefore, even when an increased amount of alkylbenzene oil is incorporated in the ether oil as compared with the ester oil or the like, the two-layer separation temperature of the HFC refrigerant and the mixed oil (ether oil and the alkylbenzene oil) can be reduced. Therefore, the ratio of the alkylbenzene oil relative to the refrigerating machine oil can be increased, and the sludge adhered to the inner surfaces of the capillary and the expansion valve can be more effectively removed. It is to be noted that a refrigerating machine oil obtained by mixing a second synthetic oil of an ester oil, a mixed oil comprised of an ether oil and an ester oil, a fluorine oil or a carbonate oil with the first synthetic oil of the alkylbenzene oil may be employed in the second embodiment.

Third Embodiment

Figure 6:
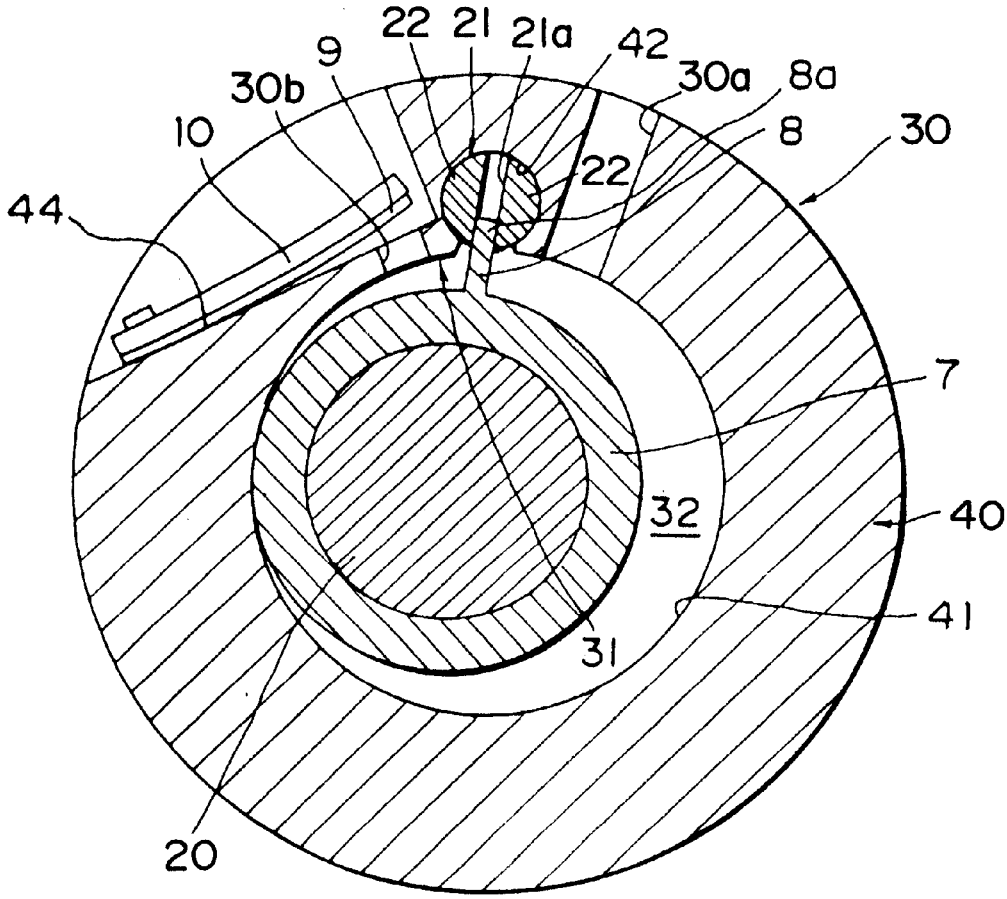
FIG. 6 is a cross section view showing essential part of a swing type compressor provided for a refrigerator according to a third embodiment of the present invention.

FIG. 6 shows a swing type compressor provided for a refrigerator according to a third embodiment of the present invention.

This swing type compressor includes a compressor element 30. The compressor element 30 includes a cylinder 40 internally having a cylinder chamber 41 and a roller 7 arranged revolvably inside the cylinder chamber 41. Then, the roller 7 is relatively rotatably fitted on an eccentric section 20 of a driving shaft (not shown). On the other hand, an inlet port 30*a* and an outlet port 30*b* opened at the cylinder chamber 41 are formed at the wall of the cylinder 40. On the outer peripheral surface of the roller 7 is integrally formed a blade 8 that is projecting radially outwardly of the roller 7. On the other hand, a cylindrical retainer hole 42 is formed in a portion between the inlet port 30*a* and the outlet port 30*b* of the cylinder 40. Then, a support member 21 comprised of two semicylindrical members 22 and 22 having a semicircular cross-section shape is rotatably fitted in this retainer hole 42. Opposite flat surfaces of the semicylindrical members 22 constitute a reception groove 21*a*. This reception groove 21*a* has one end communicated with the inside of the cylinder chamber 41, while a tip portion 8*a* of the blade 8 is slidably inserted in this reception groove 21*a* while being able to come in surface contact with it. This blade 8 divides the inside of the cylinder chamber 41 into a compression chamber 31 and an inhalation chamber 32. A plate-shaped valve 9 for opening and closing the outlet port 30*b* is provided so as to fit on a valve seat surface 44 formed around the exit of the outlet port 30*b*. A backing plate 10 is stuck to this valve 9.

Then, the swing type compressor employs HFC R410A that is an substitute fleon refrigerant as a working fluid to be compressed inside the cylinder chamber 41. As a lubricating oil, an ether oil and an alkylbenzene oil having a compatibility with the HFC refrigerant are concurrently employed. This R410A is one mixed refrigerant of HFC32 and HFC125.

This refrigerator employs a capillary tube as a decompressing means.

In the refrigerator constructed as above, when the driving shaft is driven, the protruding tip portion 8*a* of the blade 8 integrated with the roller 7 moves inward and outward along the reception groove 21*a* of the support member 21, while the support member 21 rotates simultaneously with the movement. That is, the blade 8 consistently comparts the inside of the cylinder chamber 41 into the compression chamber 31 and the inhalation chamber 32 by advancing and retreating while swaying in accordance with the revolution of the roller 7.

According to this refrigerator, while the roller 7 is revolved without rotating relative to the eccentric section 20, i.e., while it is made to swing (rock) about the blade 8, the tip portion of the blade 8 does not move in line contact with the peripheral surface of the roller 7, meaning that the blade 8 and the roller 7 do not relatively move differently from the prior art. Therefore, no slide friction occurs due to the line contact between the blade 8 and the roller 7. Then, the surface of the blade 8 seals the support member 21 while being put in surface contact with the support member 21, and therefore, no boundary lubricating state occurs.

Therefore, according to the refrigerator employing the above swing type compressor, the sludge adhered to the inner surfaces of the small-diameter portions of the capillary and the expansion valve can be exfoliated and removed by the alkyibenzene oil even when an alternative fleon refrigerant that takes the environmental safety into consideration is employed. Furthermore, the blade 8 is made to slide in surface contact with the support member 21, and therefore, the deterioration of the lubricating oil can be prevented, so that the seizure can be prevented.

In the first embodiment, the refrigerating machine oil obtained by mixing the first synthetic oil comprised of the alkylbenzene oil with the second synthetic oil comprised of the ether oil, ester oil, fluorine oil and the carbonate oil is employed. However, it is of course acceptable to employ a refrigerating machine oil obtained by mixing the first synthetic oil comprised of the alkylbenzene oil with the second synthetic oil comprised of other than the ether oil, ester oil, fluorine oil and the carbonate oil.

In the first embodiment, the first synthetic oil comprised of the alkylbenzene oil is incorporated into the second synthetic oil comprised of one of the ether oil, ester oil, fluorine oil and the carbonate oil. However, it is acceptable to incorporate the alkylbenzene oil into the mixed oil comprised of the ether oil and the ester oil. In this case, the ester oil is hydrolyzed by water but deterioration by oxidation scarcely occurs. On the contrary, the ether oil is deteriorated by oxidation but scarcely hydrolyzed by water since it withstands water. Therefore, by setting the ratio of the ether oil to the ester oil to 1:1, a refrigerating machine oil of which the degree of deterioration by oxidation and the degree of hydrolysis by water are each reduced half can be obtained.

Furthermore, the first and second embodiments have been described with reference to a refrigerator employing an HFC refrigerant. However, the refrigerant is not limited to the HFC refrigerant, and it may also be the HCFC refrigerant or the like. In this case, the refrigerating machine oil of the present invention causes no trouble even if a refrigerating machine oil such as the mineral oil for HCFC refrigerant enters. Furthermore, also by virtue of the compatibility with the HCFC refrigerant R-22 or the like, the HCFC refrigerant of the refrigerator can easily be replaced by the HFC refrigerant (so-called the retrofit can be easily achieved) without changing the refrigerating machine oil by filling the refrigerator employing the HCFC refrigerant with the refrigerating machine oil of the present invention.

In the third embodiment, the refrigerating machine oil of the present invention is employed in the swing type compressor. However, it is acceptable to employ the refrigerating machine oil of the present invention in a rotary type compressor in which a vane and a rotor are separated and the tip of the vane comes in contact with the outer peripheral surface of the rotor or a scroll compressor in which gas is compressed between two scrolls.

INDUSTRIAL APPLICABILITY

The refrigerating machine oil of the present invention and refrigerator employing the same is applied to a refrigerator for freezing and refrigerating foods and so on and to an air conditioner for executing cooling and heating inside a room.

What is claimed is:

1. A mixture consisting of a hydrofluorocarbon refrigerant and a refrigerating machine oil obtained by mixing a first synthetic oil comprised of an alkylbenzene oil and a second synthetic oil other than alkylbenzene oil, wherein a refrigerant rich layer has an oil concentration of 2.5 or more percent by weight when the refrigerating machine oil and the hydrofluorocarbon refrigerant are separated into two layers at a temperature of 0° C., wherein a ratio of the alkylbenzene oil relative to the refrigerating machine oil is 5 to 50 percent by weight, and wherein the second synthetic oil is selected from the group consisting of an ether oil, a fluorine oil, and a carbonate oil.

2. A mixture as claimed in claim 1, wherein the refrigerating machine oil has a viscosity of not smaller than 2.5 cst at a temperature of 100° C.

3. A mixture as claimed in claim 1, wherein a temperature at which the hydrofluorocarbon refrigerant and the refrigerating machine oil separate into two layers is not higher than 10° C.

4. A refrigerator employing the mixture claimed in claim 1.

5. A refrigerator as claimed in claim 4, wherein a capillary is employed as a decompressor.

6. A refrigerator as claimed in claim 4, wherein a high-pressure dome compressor is employed, and the refrigerating machine oil has a viscosity of not smaller than 2.5 cst at a temperature of 100° C.

7. A refrigerator as claimed in claim 4, wherein a low-pressure dome compressor is employed, and a temperature at which the hydrofluorocarbon refrigerant and the refrigerating machine oil separate into two layers is not higher than 10° C.

* * * * *